United States Patent [19]

Sequeira, Jr.

[11] 4,328,092

[45] May 4, 1982

[54] SOLVENT EXTRACTION OF HYDROCARBON OILS

[75] Inventor: Avilino Sequeira, Jr., Port Arthur, Tex.

[73] Assignee: Texaco Inc., White Plains, Tex.

[21] Appl. No.: 128,164

[22] Filed: Mar. 7, 1980

[51] Int. Cl.[3] ..... C10G 21/20

[52] U.S. Cl. ..... 208/326

[58] Field of Search ..... 208/320, 321, 322, 326, 208/327, 335

[56] References Cited

U.S. PATENT DOCUMENTS

| | | | |
|---|---|---|---|
| 2,261,287 | 11/1941 | Read | 208/320 X |
| 2,261,799 | 11/1941 | Franklin | 208/321 X |
| 2,305,038 | 12/1942 | Schumacher | 208/321 X |
| 3,306,849 | 2/1967 | Bozeman et al. | 208/314 |
| 4,057,491 | 11/1977 | Bushnell et al. | 208/321 |

*Primary Examiner*—Delbert E. Gantz
*Assistant Examiner*—William Leader
*Attorney, Agent, or Firm*—Cooper, Dunham, Clark, Griffin & Moran

[57] ABSTRACT

A solvent refining process utilizing N-methyl-2-pyrrolidone as solvent in which the extract from the solvent extraction zone is cooled to form two immiscible liquid phases, a secondary extract phase and a secondary raffinate phase. The secondary raffinate phase is returned to the extraction zone resulting in increased yield of refined oil product and savings in energy required for the process.

3 Claims, 1 Drawing Figure

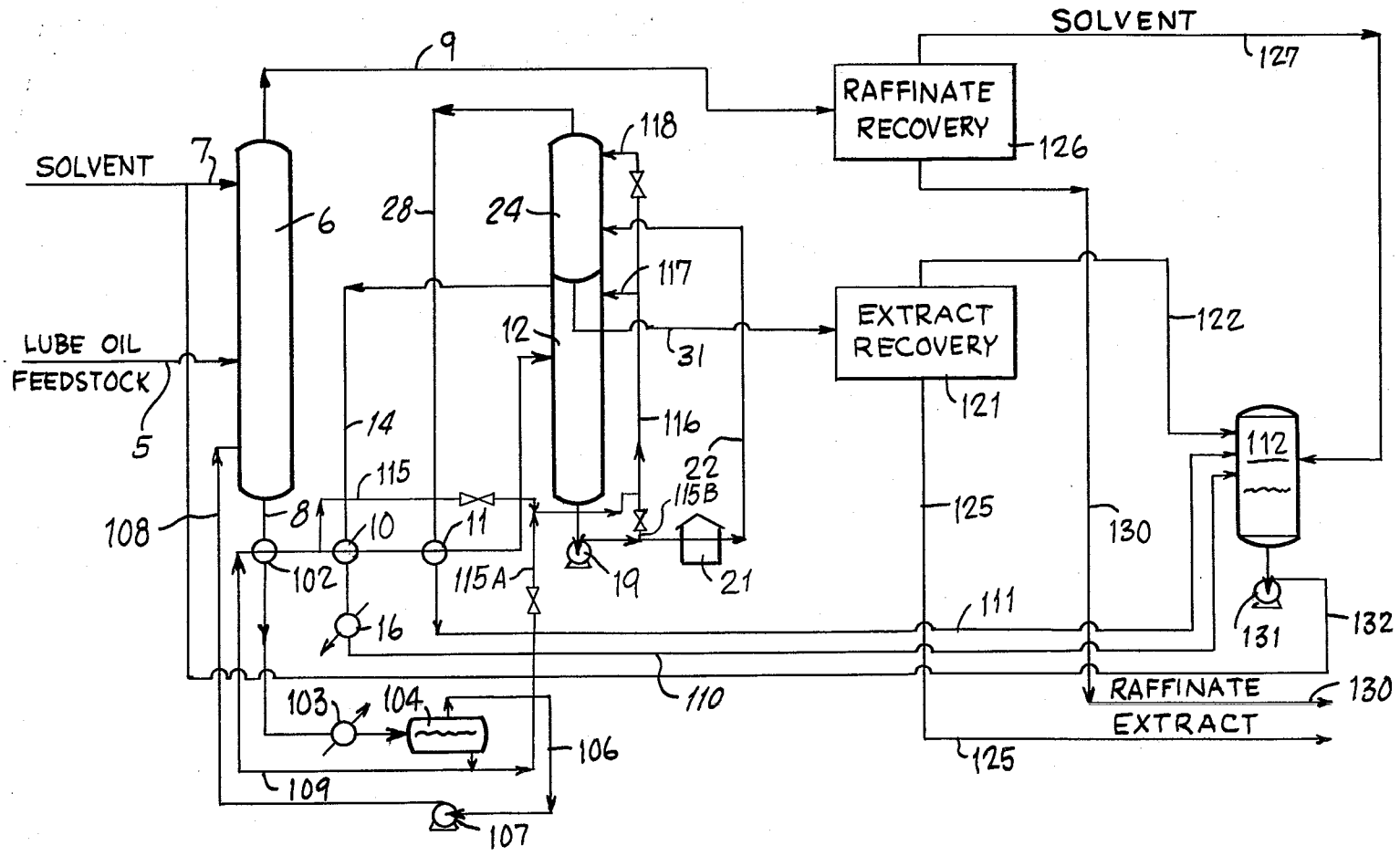
SOLVENT
RAFFINATE RECOVERY
EXTRACT RECOVERY
RAFFINATE
EXTRACT
SOLVENT
LUBE OIL FEEDSTOCK

SOLVENT EXTRACTION OF HYDROCARBON OILS

The invention relates to an improved process for the solvent extraction of a petroleum oil fraction containing aromatic and non-aromatic components. In one of its more specific aspects, the invention relates to a method for improving the refined oil yield in a solvent extraction process with a concomitant reduction in solvent dosage based on the refined oil product with a resultant energy savings.

It is well known that aromatic and unsaturated components of a lubricating oil base stock, such as those derived from crude petroleum by fractional distillation, may be separated from the more saturated hydrocarbon components by various processes involving solvent extraction of the aromatic and unsaturated hydrocarbons. Foremost among the processes which have received commercial acceptance are extraction with furfural and N-methyl-2-pyrrolidone. The removal of aromatics and other undesirable constituents from lubricating oil base stocks improves the viscosity index, color, oxidative stability, thermal stability, and inhibition response of the base oils and the ultimate lubricating oil products.

The process of the present invention employs N-methyl-2-pyrrolidone as a solvent for extracting aromatic hydrocarbons from mixtures of aromatic and non-aromatic hydrocarbons. The advantages of N-methyl-2-pyrrolidone over other solvents as a lubricating oil extraction solvent for the removal of undesirable aromatic and polar constituents from lubricating oil base stocks are known in the art and are disclosed, for example, in U.S. Pat. No. 4,057,491. In particular, N-methyl-2-pyyrolidone is chemically stable, has low toxicity, and has the ability to produce refined oils of improved quality as compared with other known solvents. Processes employing N-methyl-2-pyrrolidone as solvent and illustrating conventional processing operations are disclosed in U.S. Pat. Nos. 3,451,925; 3,461,066; 3,470,089; and 4,013,549.

In conventional lubricating oil refining with N-methyl-2-pyrrolidone, the solvent extraction step is carried out under conditions effective to recover about 30 to 90 volume percent of the lubricating oil charge as raffinate or refined oil and to extract about 10 to 70 volume percent of the charge as an aromatic extract. The lubricating oil stock is contacted with the solvent, N-methyl-2-pyrrolidone, at a temperature at least 10° C., preferably at least 50° C., below the temperature of complete miscibility of the lubricating oil stock in the solvent.

In the extraction step, operating conditions are selected to produce a primary raffinate having a dewaxed viscosity index of about 75 to 100, and preferably about 85 to 96. Solvent extraction temperatures are generally within the range of 43° to 100° C. (110° to 212° F.), preferably within the range of 54° to 95° C. (130° to 205° F.), with solvent dosages within the range of 50 to 500 percent, and preferably within the range of 100 to 300 percent.

To produce a finished lubricating oil base stock, the primary raffinate is dewaxed to the desired pour point. If desired, the refined or dewaxed oil may be subjected to a finishing treatment for color and stability improvement, for example, mild hydrogenation.

The present invention provides an improvement in the solvent refining of lubrication oil stocks with N-methyl-2-pyrrolidone extraction processes wherein the primary extract mixture from the solvent extraction zone is cooled to a temperature below the temperature at which the primary extract is obtained and sufficient to form two immiscible liquid phases. One phase, a secondary raffinate phase, is relatively poorer in extracted components than the primary extract mixture from the solvent extraction zone and the other, a secondary extract phase, is relatively richer in extracted components than the primary extract. The secondary raffinate phase is separated from the secondary extract phase and returned to the extraction zone into contact with lubricating oil stock and solvent. The secondary raffinate may be admixed with the charge stock or introduced into the extraction tower at some point below the point of introduction of the solvent, preferably at a point intermediate the point of introduction of the charge stock and the point of withdrawal of the primary extract from the extraction zone.

It is known that a secondary raffinate may be separated from a primary extract mixture obtained when a mineral oil is extracted with a selective solvent. U.S. Pat. No. 2,081,720 (Re. 22,788) discloses the formation of a secondary raffinate from lubricating oil extracts using selective solvents, such as furfural and phenols, and recycle of the secondary raffinate to the extraction tower to improve the composition and/or yield of a secondary extract. Similarly, U.S. Pat. Nos. 2,261,799 and 2,305,038 disclose recycle of secondary raffinate in furfural and phenol lubricating oil solvent refining processes. Such processes generally are characterized by either a decrease in quality of refined oil at a given solvent to product oil dosage or an increase in solvent dosage based on the volume of refined oil product, or both. It has been discovered, unexpectedly, that the process of this invention results in an improved yield of refined lubricating oil stock or a specified product quality with a reduced solvent dosage based on the volume of product. The process thus provides both a method of increasing product yield from a given feedstock and a means for saving energy required for the production of a given volume of product.

Details of the process of this invention will be evident from the accompanying drawing wherein the FIGURE is a schematic flow diagram illustrating a solvent refining process embodying the improved process of this invention.

With reference to the drawing, a preferred embodiment of the subject invention is disclosed as applied to solvent refining lubricating oil feedstocks. Dry lubricating oil feedstock enters the system through line 5 and is introduced into extraction tower 6 where it is brought into intimate countercurrent contact with a solvent for the aromatic and unsaturated components of the lubricating oil feedstock. The solvent enters the upper portion of the extraction tower through line 7.

In the extraction tower 6, the lubricating oil feedstock is intimately countercurrently contacted with N-methyl-2-pyrrolidone. Extraction tower 6 typically operates at a pressure in the range of 550 to 1000 kPa (80 to 145 psia). The resulting primary extract is withdrawn from the bottom of extraction tower 6 through line 8 and passed through a heat exchanger 102 which serves to cool the primary extract mixture and then through a cooler 103 which it is further cooled to a temperature sufficiently lower than the temperature in extraction tower 6 to form two immiscible liquid phases into decanter 104 wherein the separation of the two phases occurs. Cooling of the primary extract from extraction tower 6 to a temperature approximately 10° C. (18° F.) or more below the temperature existing at the bottom of the extraction tower results in the formation of two liquid phases which are separated from one another by gravity in decanter 104. One of the liquid phases, a secondary extract, is relatively richer in aromatic hydrocarbons than the mixture withdrawn from the extraction tower and the other, a secondary raffinate, is relatively poorer in aromatic hydrocarbons. The primary extract may be cooled 10° to 40° C. before separation of the secondary raffinate.

The secondary raffinate is withdrawn from the upper part of decanter 104 through line 106 and returned by pump 107 to the lower part of extraction tower 6 through line 108. The secondary raffinate may be introduced into the extraction tower 6 at any level below the point of introduction of solvent to the tower, either as a separate stream or in admixture with the feedstock.

The recycle of secondary raffinate in accordance with this invention results in an increased yield of raffinate with a reduction in solvent dosage on the basis of the volume of fresh feedstock and of the refined oil. Secondary raffinate is recycled in an amount within the range of 0.1 to 0.5 volumes of secondary extract per volume of lubricating oil charge stock.

A secondary extract phase is withdrawn from the lower part of decanter 104 and passed through line 109 and heat exchanger 102 in indirect heat exchange with the primary extract from extraction tower 6, thereby cooling the primary extract and heating the secondary extract. The secondary extract is then passed through heat exchangers 10 and 11 to low pressure flash tower 12 in conventional manner for recovery of solvent from the extract. Tower 12 typically operates at a pressure 170 to 205 kPa (10 to 15 psig). Secondary extract from line 109 is introduced into the upper part of tower 12 as reflux through lines 115, 116 and 117. Solvent separated from the extract in low pressure flash tower 12 is passed through line 14 to heat exchanger 10 wherein solvent vapors are cooled and condensed, preheating the feed stream to tower 12, and then passed through cooler 16 and line 110 to solvent accumulator 112 for reuse in the process.

The unvaporized portion of the extract mixture withdrawn from the bottom of fractionation column 12 by pump 19 is passed through heater 21 and line 22 to a high pressure flash tower 24. The high pressure flash tower 24 typically operates at a pressure in the range of 375 to 415 kPa (40 to 45 psig), and is provided with a reflux of extract which enters tower 24 through line 118. A further amount of solvent is separated from the extract in flash tower 24. Solvent vapors leaving the top of the high pressure flash tower 24 through line 28 are passed through heat exchanger 11 in indirect heat exchange with the secondary extract mixture from the decanter 104, condensing the solvent vapors and preheating the extract mixture prior to its introduction to low pressure flash tower 12. Recovered solvents is passed through line 111 to a solvent accumulator 112 for reuse in the process.

The hydrocarbon oil extract withdrawn from the lower portion of high pressure flash tower 24 through line 31 still contains some solvent, for example, 5 to 15 volume percent solvent and 95 to 85 volume percent hydrocarbons. The extract mixture withdrawn from the bottom of tower 24 is passed to an extract recovery system 121 wherein extract, usually containing less than 50 ppm solvent, is recovered as a product of the process. The extract recovery system may comprise a combination of a vacuum flash tower and stripper as in U.S. Pat. No. 3,470,089, or any other suitable extract recovery processing system. Recovered solvent is passed through line 122 to solvent accumulator 112 while product extract is discharged from the system through line 125.

The raffinate from the top of the extraction tower 6 is passed through line 9 to a raffinate recovery system 126 wherein raffinate product is recovered from solvent in any suitable manner, for example, as described in U.S. Pat. No. 3,461,066, incorporated herein by reference. Solvent separated from the primary raffinate is passed through line 127 to accumulator 112 for reuse in the process. The recovered primary raffinate, containing less than about 50 ppm solvent, is discharged through line 130 as a solvent refined oil product of the process. Solvent from accumulator 112 is recirculated to extraction tower 6 by pump 131 through lines 132 and 7.

Instead of passing extract from decanter 104 through lines 109 and 115 to towers 12 and 24 as reflux via lines 117 and 118, relatively cool secondary extract from decanter 104 may be passed directly to line 116 via line 105A. Alternatively, although less desirably, partially stripped extract from the lower part of tower 12 may be employed as reflux in towers 12 and 24 via line 115B.

The following examples illustrate preferred embodiments of the process of this invention.

EXAMPLE 1

In two test runs (Runs 1 and 2) a wax distillate 7 (WD-7) is solvent extracted with N-methyl-2-pyrrolidone in a continuous counterflow unit at a temperature of 54° C. (130° F.). This lubricating oil stock has a refractive index at 70° C. ($RI_{70}$) of 1.4724, an API gravity of 28.8, a Saybolt Universal Seconds (SUS) Viscosity at 38° C. (100° F.) of 141.3, a viscosity index of 79, and a pour point of 24° C. (75° F.).

In two comparable test runs (Runs 3 and 4) a charge stock WD-7 having a refractive index ($RI_{70}$) of 1.4691, an API gravity of 28.4, SUS Viscosity at 38° C. (100° F.) of 125.4, a viscosity index of 85 and a pour point of 24° C. (75° F.) is first solvent extracted with N-methyl-2-pyrrolidone at 54° C. (129° F.) and the extract mixture cooled to 43° C. (110° F.) forming a secondary raffinate phase and a secondary extract phase. Mixtures of 70 volume percent of this wax distillate charge stock and 30 volume percent of the so-formed secondary raffinate, stripped of solvent, are subjected to solvent extraction with N-methyl-2-pyrrolidone at 54° C. (130° F.). Results of these tests are indicated in Table I.

TABLE I

| Run No. | 1 | 2 | 3 | 4 |
|---|---|---|---|---|
| Process Type | Straight | Straight | Recycle | Recycle |
| Solvent Dosage, Vol. % | | | | |
| Basis Charge | 300 | 700 | 300 | 700 |
| Basis Fresh Feed | 300 | 700 | 210 | 490 |
| Basis Refined Oil | 444 | 715 | 397 | 569 |
| Refined Oil | | | | |
| Yield, Vol. %(1) | 67.6 | 42.0 | 75.5 | 52.8 |
| Refractive Index(2) | 1.4590 | 1.4550 | 1.4588 | 1.4552 |

(1) Basis Fresh Feed
(2) At 70° C. ($RI_{70}$)

The data in the foregoing table indicate that the yield of the refined oil product having a substantially identical refractive index is improved by invention as compared with straight solvent refining, while the solvent dosage per barrel of product is reduced. Run 3, for example, shows an increased yield of 7.9 volume percent with 10.6 percent less solvent per barrel of refined oil product as compared with Run 1. Similarly, Run 4, as compared with Run 2, shows a 10.8 percent increase in product with 20.4 percent less solvent per barrel of refined oil product as compared with Run 2.

EXAMPLE 2

In another series of tests, a wax distillate 20 (WD-20) feedstock is solvent extracted with N-methyl-2-pyrrolidone at 82° C. (180° F.) in a continuous counterflow unit. This lubricating oil charge stock has a refractive index ($RI_{70}$) of 1.4868, an API gravity of 23.8, a SUS viscosity at 99° C. (210° F.) of 56.5, a VI of 70 and a pour point of 38° C. (100° F.). In Run 5, a straight charge is extracted with N-methyl-2-pyrrolidone in a countercurrent extraction unit at 82° C. (180° F.) with the results shown in Table II. The extract mixture from Run 5 is cooled to 43° C. (110° F.) to form a secondary raffinate, and in Run 6, the resulting secondary raffinate is blended with the wax distillate 20 (WD-20) feedstock in relative proportions of 75 parts by volume WD-20 and 25 parts by volume of unstripped secondary raffinate to simulate recycle of secondary raffinate to the extraction zone, and the mixture extracted with N-methyl-2-pyrrolidone at 82° C. with the results shown in Table II.

TABLE II

| Run No.<br>Process Type | 5<br>Straight | 6<br>Recycle |
|---|---|---|
| Solvent Dosage, Vol. % | | |
| Basis Charge | 198 | 228 |
| Basis Fresh Feed | 198 | 171 |
| Basis Refined Oil | 413 | 404 |
| Refined Oil | | |
| Yield, Vol. %(1) | 47.9 | 56.3 |
| Refractive Index(2) | 1.4568 | 1.4567 |

(1)Basis Fresh Feed
(2)At 70° C. ($RI_{70}$)

The refractive index is an indication of the viscosity index of the finished oil after dewaxing of the refined oil. From the wax distillate 20 feedstock, the solvent refined oils of this example, having a refractive index ($RI_{70}$) of 1.4570 will, after dewaxing to 0° F. pour, exhibit a viscosity index of about 100. In general, as the refractive index decreases the quality of the refined oil product increases. The above data in Table II indicate that under comparable conditions for the production of refined oil of identical refractive indices from a wax distillate 20, the process of this invention resulted in an 8.4 volume percent increase in refined oil product, basis fresh feedstock, with a decrease in solvent dosage, basis refined oil product, of 9.0 percent.

It will be evident from the foregoing examples that recycle of secondary raffinate in accordance with the process of the present invention results in higher yields of refined oil and savings in energy requirements for the process as evidenced by decreased volume of solvent required per volume of refined oil product.

I claim:

1. In a method of solvent refining a petroleum based lubricating oil stock containing aromatic and non-aromatic components with N-methyl-2-pyrrolidone wherein said lubricating oil stock is contacted with N-methyl-2-pyrrolidone in a solvent extraction zone at a temperature in the range of 50° to 120° C. (120° to 250° F.) and a solvent to oil dosage in the range of 100 to 300 volume percent forming an aromatics-rich primary extract and a solvent refined oil raffinate having a predetermined refractive index, the improvement which comprises separating said primary extract from said raffinate, cooling the aromatics-rich primary extract to a temperature in the range of 10° C. (18° F.) to 45° C. (113° F.) below said solvent extraction temperature whereby two separate liquid phases are formed consisting of a secondary extract phase relatively richer in aromatic hydrocarbons than said primary extract and a secondary raffinate phase relatively poorer in aromatic hydrocarbons than said primary extract, separating said secondary raffinate from said secondary extract, returning 0.1 to 0.5 volumes of said secondary raffinate to said solvent extraction zone for each volume of lubricating oil stock supplied to said solvent extraction zone into admixture with said lubricating oil stock in said zone, supplying a substantially reduced dosage of solvent to fresh feed lubricating oil stock to said solvent extraction zone producing an increased yield of a solvent refined oil raffinate of said predetermined refractive index, and withdrawing said refined oil raffinate from said extraction zone.

2. A process according to claim 1 in which the contacting temperature in said solvent extraction zone is within the range of 50° to 80° C. (120° and 180° F.).

3. A process according to claim 1 in which the secondary raffinate and secondary extract phases are separated from one another at a temperature in the range of 25° to 70° C. (77° to 158° F.).

* * * * *